US009464442B1

(12) United States Patent
Olczyk et al.

(10) Patent No.: US 9,464,442 B1
(45) Date of Patent: Oct. 11, 2016

(54) WALL CLADDING ASSEMBLY METHOD AND SYSTEM

(71) Applicant: Stone Master SA, Lódz (PL)

(72) Inventors: Szymon Olczyk, Lódz (PL); Tomasz Koloszczyk, Lódz (PL); Krzysztof Ratajczyk, Lódz (PL)

(73) Assignee: STONE MASTER SA (PL)

( * ) Notice: Subject to any disclaimer, the term of this patent is extended or adjusted under 35 U.S.C. 154(b) by 0 days.

(21) Appl. No.: 14/825,634

(22) Filed: Aug. 13, 2015

(51) Int. Cl.
*E04B 2/00* (2006.01)
*E04F 13/08* (2006.01)
*E04F 13/14* (2006.01)

(52) U.S. Cl.
CPC ..... *E04F 13/0862* (2013.01); *E04F 13/0871* (2013.01); *E04F 13/144* (2013.01)

(58) Field of Classification Search
CPC . E04F 13/0803; E04F 13/142; E04F 13/144; E04F 13/185; E04F 13/0801; E04F 13/14; E04F 13/072; E04F 13/21; E04F 13/083; E04F 13/0871; E04F 13/0862
See application file for complete search history.

(56) References Cited

U.S. PATENT DOCUMENTS 1,854,772 A * 4/1932 Stuken ..... E04F 13/0816 52/773
2,003,996 A * 6/1935 Finzer ..... E04F 13/0803 52/275
2,016,918 A 10/1935 Born
2,022,363 A * 11/1935 Vertuno ..... E04F 13/0801 52/386
2,066,268 A * 12/1936 Hohner ..... E04F 13/0803 52/275
2,087,931 A * 7/1937 Wallace ..... E04F 13/0803 52/387
2,132,499 A * 10/1938 Tuthill ..... E04F 13/0801 52/259
2,205,700 A 6/1940 Smith
2,664,978 A * 1/1954 Fox ..... E04F 13/0803 52/416
2,938,376 A * 5/1960 Workman ..... E04F 13/0862 52/314
3,005,293 A 10/1961 Hunter
3,852,929 A * 12/1974 Cookson ..... E04D 3/3607 52/543
4,238,915 A * 12/1980 Yoshida ..... E04F 13/14 52/386
4,553,366 A * 11/1985 Guerin ..... E04F 13/0803 52/506.08
4,635,424 A * 1/1987 Drapeau ..... E04B 9/24 52/480
4,662,140 A * 5/1987 Porter ..... E04F 13/0885 52/385
4,773,201 A * 9/1988 Trezza ..... E04F 13/0862 52/387
4,856,245 A * 8/1989 Osawa ..... E04F 13/0832 52/386

(Continued)

*Primary Examiner* — Brian Mattei
*Assistant Examiner* — Gisele Ford
(74) *Attorney, Agent, or Firm* — Reichel Stohry LLP; Mark C. Reichel; Natalie J. Dean

(57) ABSTRACT

A wall cladding assembly is disclosed. The wall cladding assembly includes a wall cladding tile having a substantially flat surface, a mounting channel attached to the flat surface and at least one anchor secured to the mounting channel. The mounting channel includes a planar base plate, a pair of flanges along parallel edges of the base plate and a pair of lips at outer edges of the flanges. The base plate, the flanges and the lips define a first recess and a second recess. The at least one anchor includes an anchor plate and a pair of projections extending from the anchor plate. A first projection has a first securing lip and a second projection has a second securing lip, the first securing lip having a portion sized to fit in the first recess and the second securing lip having a portion sized to fit in the second recess.

19 Claims, 4 Drawing Sheets

(56) References Cited

U.S. PATENT DOCUMENTS 4,856,246 A * 8/1989 Shimasaki ..... E04F 13/0803 52/386
4,890,433 A 1/1990 Funaki
4,916,875 A * 4/1990 Kashiwagi ..... E04F 13/0851 52/302.3
4,987,712 A * 1/1991 Mancuso ..... E04F 13/0862 52/387
5,228,937 A * 7/1993 Passeno ..... E04F 13/0801 156/297
5,265,396 A 11/1993 Amimoto
5,373,676 A 12/1994 Francis et al.
5,390,457 A * 2/1995 Sjolander ..... E04F 13/0803 52/387
5,555,690 A 9/1996 Cosentino
5,860,261 A * 1/1999 LeBlanc ..... E04F 13/14 52/385
5,893,248 A * 4/1999 Beliveau ..... E04B 1/80 52/309.16
6,098,363 A * 8/2000 Yaguchi ..... E04F 13/0801 52/385
6,138,423 A * 10/2000 Poutanen ..... E04F 13/0803 52/311.2
6,164,029 A 12/2000 Lee
6,226,947 B1 * 5/2001 Bado ..... E04F 13/0805 52/235
6,315,489 B1 * 11/2001 Watanabe ..... E04F 13/0846 248/220.21
6,964,137 B2 11/2005 Frascari
6,990,778 B2 * 1/2006 Passeno ..... E04F 13/14 52/385
8,359,811 B2 1/2013 Muller
8,769,902 B2 7/2014 King et al.
8,782,988 B2 * 7/2014 Wolf ..... E04F 13/147 52/526
8,898,975 B2 12/2014 Tsai
8,935,896 B2 * 1/2015 Tancredi ..... E04F 13/0862 52/302.1
9,016,020 B1 * 4/2015 Yang ..... E04F 13/0803 52/511
2001/0011443 A1 * 8/2001 Watanabe ..... E04F 13/0816 52/506.05
2004/0231262 A1 * 11/2004 Kornfalt ..... E04F 13/0826 52/311.1
2005/0284063 A1 * 12/2005 Losse ..... E04F 13/14 52/384
2006/0265988 A1 * 11/2006 Fujito ..... E04F 13/0889 52/511
2007/0041786 A1 * 2/2007 Rausch ..... B44C 5/0415 404/34
2007/0130860 A1 * 6/2007 Paquette ..... E04F 13/0835 52/311.1
2007/0220821 A1 * 9/2007 Omiya ..... E04F 13/0862 52/391
2008/0155921 A1 * 7/2008 Wolf ..... B28B 23/0062 52/386
2008/0163575 A1 * 7/2008 Pratt ..... B28B 17/0072 52/293.2
2009/0007515 A1 * 1/2009 Mercer ..... E04F 13/0862 52/483.1
2009/0031652 A1 * 2/2009 Ortega Gatalan .... E04F 13/081 52/235
2009/0313935 A1 * 12/2009 Montgomery ..... E04F 13/081 52/506.1
2010/0132268 A1 * 6/2010 Vardaro ..... A47F 5/0846 52/36.5
2011/0047916 A1 * 3/2011 Muller ..... E04F 13/0816 52/477
2011/0203212 A1 * 8/2011 Matys ..... B28B 23/005 52/562
2012/0117904 A1 * 5/2012 Bouchard ..... E04F 13/0862 52/309.4
2012/0241574 A1 * 9/2012 Uota ..... E04F 13/0846 248/231.81
2012/0304572 A1 * 12/2012 Aboukhalil ..... E04F 13/0733 52/489.1
2012/0304573 A1 * 12/2012 Aboukhalil ..... E04F 13/0816 52/506.05
2012/0317909 A1 * 12/2012 MacKenzie ..... E04F 13/0803 52/288.1
2013/0186027 A1 * 7/2013 Sharpe ..... E04B 2/00 52/506.05
2013/0312352 A1 * 11/2013 Gale ..... E04F 13/24 52/483.1
2014/0150614 A1 * 6/2014 Aboukhalil ..... E04F 13/007 83/39
2014/0161516 A1 * 6/2014 Deumer ..... E04F 13/081 403/345
2014/0165492 A1 * 6/2014 Friedman ..... E04F 13/0805 52/506.05
2014/0260043 A1 * 9/2014 Cottier ..... E04F 13/0826 52/489.2
2014/0290166 A1 * 10/2014 Bordener ..... E04F 13/0803 52/474
2015/0020468 A1 * 1/2015 Wickstrom ..... E04F 13/0816 52/274
2015/0040509 A1 * 2/2015 Peltola ..... B29C 47/04 52/582.1
2015/0052840 A1 * 2/2015 Beaty ..... E06B 1/34 52/483.1

* cited by examiner

WALL CLADDING ASSEMBLY METHOD AND SYSTEM

FIELD

The present application relates to building products and, in particular, to methods and systems for installing stone veneers, facades and other wall cladding elements.

BACKGROUND

Wall cladding, such as stone veneers and ceramic facades, are popular additions to wall surfaces as they can provide protection from weather elements and aesthetic appeal to the surfaces. A plurality of wall cladding structures may be assembled and fitted together to construct sidings on exterior or interior walls and surfaces.

Traditional methods of installing wall cladding elements typically involve applying a mortar mix or complex mechanical fixing to affix the wall cladding elements to surfaces. It would be advantageous to provide a simple, dry assembly method for wall and façade cladding surfaces.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

In one aspect, the present application describes a wall cladding assembly for use in forming a finished wall cladding surface. The wall cladding assembly includes a wall cladding tile having a first surface that is at least partially covered with cladding material and a second, substantially flat surface opposite to the first surface. A mounting channel is attached to the second surface, the mounting channel including a planar base plate disposed on the second surface, and a first flange and a second flange along two parallel edges of the base plate, extending outwardly from the second surface. The first flange has a first lip along an outer edge and the second flange has a second lip along an outer edge, the first lip and the second lip being spaced apart from and extending generally parallel to the base plate. The first lip, the first flange and the base plate define a first recess and the second lip, the second flange and the base plate define a second recess. The wall cladding assembly also includes at least one anchor secured to the mounting channel. The anchor includes an elongate anchor plate, and a first projection and a second projection extending outwardly from a first surface of the anchor plate. The first projection has a first securing lip and the second projection has a second securing lip, the first securing lip and the second securing lip being spaced apart from and extending generally parallel to the anchor plate. A portion of the first securing lip is sized to fit in the first recess and a second portion of the second securing lip is sized to fit in the second recess.

Other aspects and features of the present application will be understood by those of ordinary skill in the art from a review of the following description of examples in conjunction with the accompanying figures.

Figure 1A:
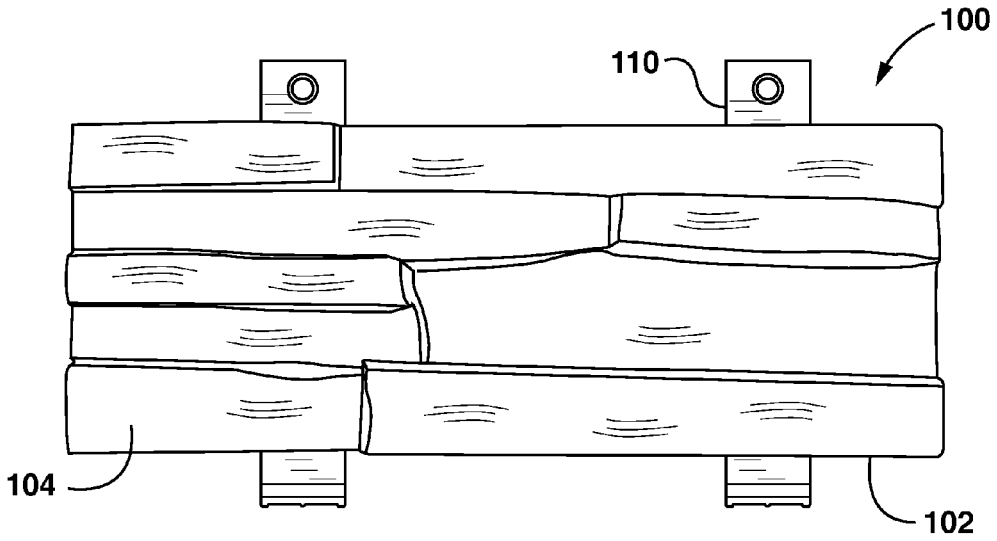
FIGS. 1A and 1B show a front side and a back side, respectively, of a wall cladding assembly in accordance with example embodiments of the present disclosure.
Figure 1B:
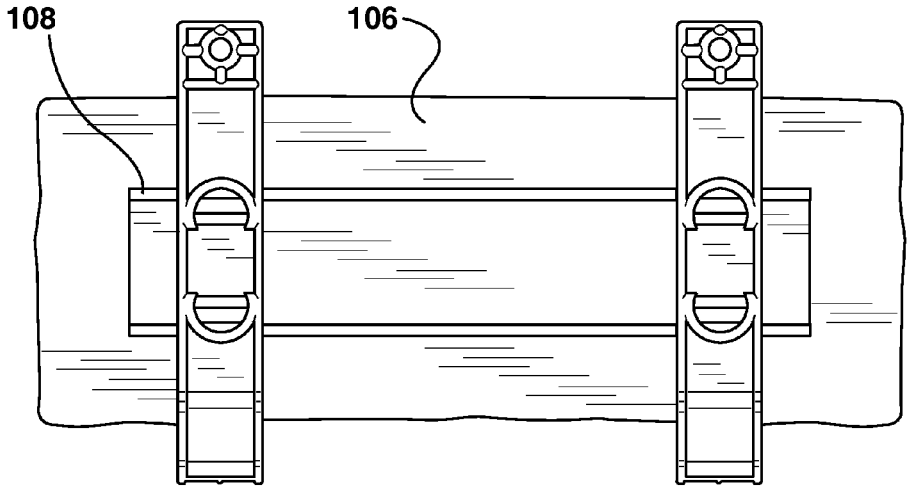

Reference is first made to FIGS. 1A and 1B which show a front face and a back face of a wall cladding assembly 100. The wall cladding assembly 100 includes a wall cladding tile 102. In at least some embodiments, the wall cladding tile 102 may be a slab of natural or manufactured stone cut to a thickness and weight appropriate for use as a stone veneer. In some embodiments, the wall cladding tile 102 may have a concrete-type base covered with stone products. The wall cladding tile 102 may take various shapes and sizes. In the example illustrated in FIGS. 1A and 1B, the wall cladding tile 102 is elongate and rectangular-shaped, having two sets of parallel edges. The wall cladding tile 102 of FIGS. 1A and 1B is oriented horizontally and has uniform thickness along its length. Other shapes and orientations of the wall cladding tile 102 are possible.

The wall cladding tile 102 includes a first surface 104 and a second surface 106. The first surface 104 is at least partially covered with cladding material. For example, in at least some embodiments, the first surface 104 may be covered by a layer of textured stone. It will be appreciated that the cladding material may be any one or a combination of several different materials such as natural stone, gypsum, vinyl, aluminum, wood, fiber cement, brick and steel. Furthermore, the wall cladding tile 102 may itself be composed of any one or a combination of a wide array of materials. In some embodiments, the wall cladding tile 102 may be an architectural or decorative panel suitable for installing on a wall surface.

The second surface 106 is opposite to the first surface 104 and is substantially flat. For example, at least a portion of the second surface 106 may be smooth and even. In some embodiments, the first surface 104 and second surface 106 are generally parallel. That is, the wall cladding tile 102 may have uniform thickness along its length. In some other embodiments, the thickness of the wall cladding tile 102 between the first surface 104 and second surface 106 may vary at different points on the wall cladding tile 102.

The wall cladding assembly 100 includes a mounting channel 108. The mounting channel 108 is attached to the second surface 106 of the wall cladding tile 102. In at least some embodiments, the mounting channel 108 is elongate and extends lengthwise on the second surface 106 along a length of the wall cladding tile 102, as in FIGS. 1A and 1B. The mounting channel 108 will be described in greater detail below with reference to FIG. 2.

The wall cladding assembly 100 also includes one or more anchors 110 secured to the mounting channel 108. The one or more anchors 110 may all have similar shapes and sizes. In at least some embodiments, each anchor 110 has an elongate body and is rectangular-shaped. As shown in FIG. 1B, when the anchors 110 are secured to the mounting channel 108, the anchors 110 are positioned orthogonal to the mounting channel 108. For example, as in FIG. 1B, the mounting channel 108 may be oriented horizontally along the second surface 106 while the anchors 110 are oriented vertically and substantially perpendicular to the mounting channel 108. The anchors 110 will be described in more detail below with reference to FIGS. 3 and 4.

Mounting Channel

Figure 2B:
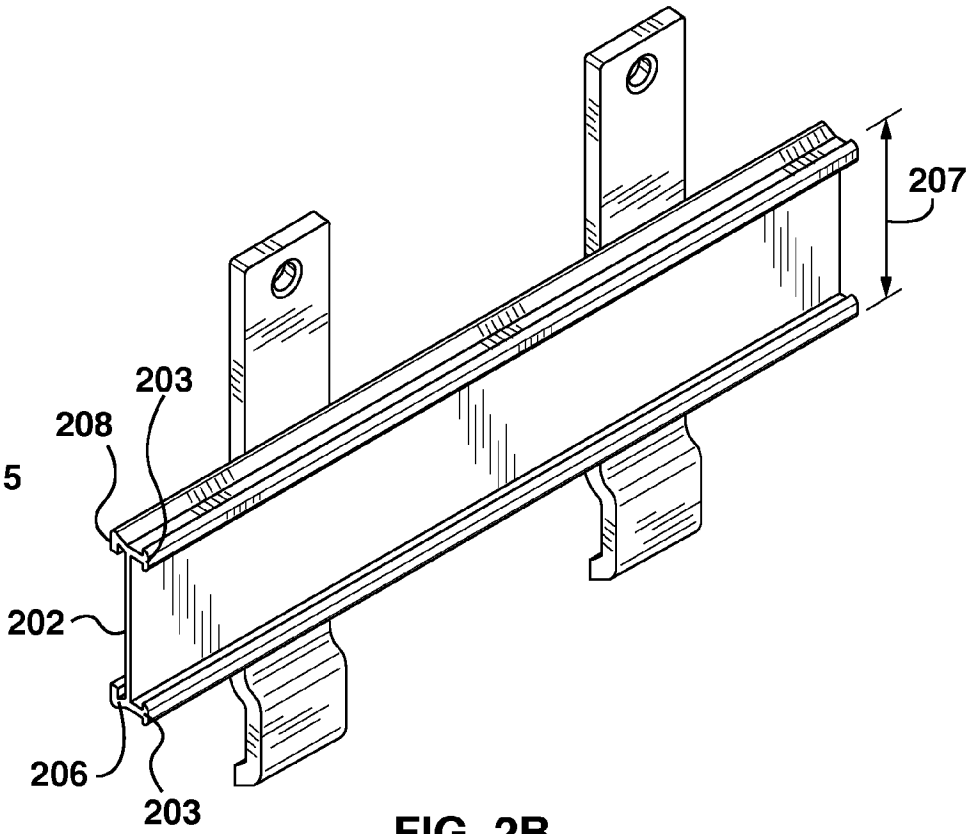
FIGS. 2A and 2B show a vertical cross-sectional view and a perspective view, respectively, of a mounting channel of the wall cladding assembly of FIGS. 1A and 1B.
Figure 2A:
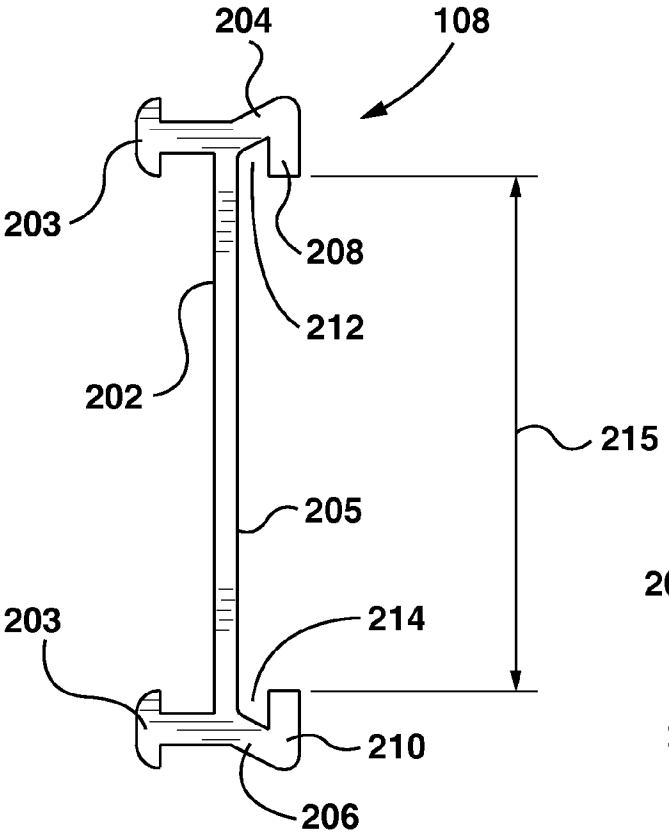

Reference is now made to FIGS. 2A and 2B, which show a vertical cross-sectional view and a perspective view, respectively, of the mounting channel 108 of the wall cladding assembly 100 of FIGS. 1A and 1B. The mounting channel 108 includes a planar base plate 202. The base plate 202 is elongate and has a rectangular shape, with two sets of parallel edges. For example, in at least some embodiments, the distance between the top edge and the bottom edge, or height 207, of the base plate 202 is greater than 5 centimeters. In some embodiments, the length of the base plate 202 may be greater than 10 centimeters.

The base plate 202 is disposed on the second surface 106 (shown in FIG. 1B) of the wall cladding tile 102 and extends lengthwise along a length of the wall cladding tile 102. It will be appreciated that the length and height 207 of the base plate 202 will vary according to the dimensions of the second surface 106 of the wall cladding tile 102 on which the base plate 202 is disposed. In particular, the length and height of the base plate 202 will be smaller than the corresponding dimensions of the second surface 106, respectively.

In at least some embodiments, the base plate 202 has a smaller surface area than the second surface 106 and lies flat against the second surface 106. The base plate 202 may be affixed to the second surface 106 in various different ways. For example, the base plate 202 may be attached to the second surface 106 by means of an adhesive applied between an inner surface of the base plate 202 and the second surface 106. The base plate 202 may also be partially embedded in the wall cladding tile 102 on the second surface 106 during the process of manufacturing the wall cladding tile 102. In some embodiments, the base plate 202 may have a pair of lipped flanges 203 extending outwardly from the inner surface of the base plate 202 such that the lipped flanges 203 may be anchored and embedded into the wall cladding tile 102 on the second surface 106, bringing the inner surface of the base plate 202 into fixed contact with the second surface 106. Other methods for affixing the base plate 202 to the second surface 106 may be available.

The mounting channel 108 includes a first flange 204 and a second flange 206 along two parallel edges of the base plate 202. In at least some embodiments, the first flange 204 extends along the top edge of the base plate 202 and the second flange 206 extends along the bottom edge of the base plate 202. The first flange 204 and the second flange 206 extend outwardly away from an outer surface 205 of the base plate 202. For example, the first flange 204 and the second flange 206 may extend orthogonally from the base plate 202 in a direction away from the second surface 106 of the wall cladding tile 102. In some embodiments, the first flange 204 and the second flange 206 extend from the base plate 202 at an obtuse angle to the base plate 202, as shown in FIG. 2. For example, the interior angle defined by the first flange 204 and the base plate 202 may be greater than 90 degrees.

The mounting channel 108 also includes a first lip 208 along an outer edge of the first flange 204 and a second lip 210 along an outer edge of the second flange 206. The first lip 208 and the second lip 210 are spaced apart from the outer surface 205 of the base plate 202 and extend on a plane generally parallel to the base plate 202. As shown in FIG. 2, the first lip 208 extends in a direction from the first flange 204 towards the second flange 206 and the second lip 210 extends in a direction from the second flange 206 towards the first flange 204. That is, the first flange 204 and the second flange 206 have in-turned lips 208 and 210, respectively, which extend towards each other.

The arrangement of the flanges 204 and 206 and the lips 208 and 210 with respect to the base plate 202 results in the formation of a C-shaped beam as shown in FIG. 2. Furthermore, the inner surfaces of the flanges and the lips collaboratively define enclosed channels extending the length of the base plate 202. More specifically, the first lip 208, the first flange 204 and the outer surface 205 of the base plate 202 define a first recess 212 and the second lip 210, the second flange 206 and the outer surface 205 define a second recess 214. The first recess 212 and the second recess 214 each have a depth and a height. The depth of the first recess 212 may be defined as the horizontal distance between the first lip 208 and the outer surface 205 of the base plate 202, while the height of the first recess 212 may be defined as the vertical distance from an inner surface of the first flange 204 to the outer end of the first lip 208. Similarly, the depth of the second recess 214 may be defined as the horizontal distance between the second lip 210 and the outer surface 205 of the base plate 202, while the height of the second recess 214 may be defined as the vertical distance between an inner surface of the second flange 206 to the outer end of the second lip 210.

In at least some embodiments, the depth of the first recess 212 and the depth of the second recess 214 are greater than 5 millimeters. In other words, the first lip 208 and the second lip 210 are spaced at least 5 millimeters away from the outer surface 205 of the base plate 202. In at least some embodiments, the height of the first recess 212 and the height of the second recess 214 may be greater than 5 millimeters. The first lip 208 may extend a distance greater than 5 millimeters from the first flange 204 towards the second flange 206 and the second lip 210 may extend a distance greater than 5 millimeters from the second flange 206 towards the first flange 204.

Anchor

Figure 3:
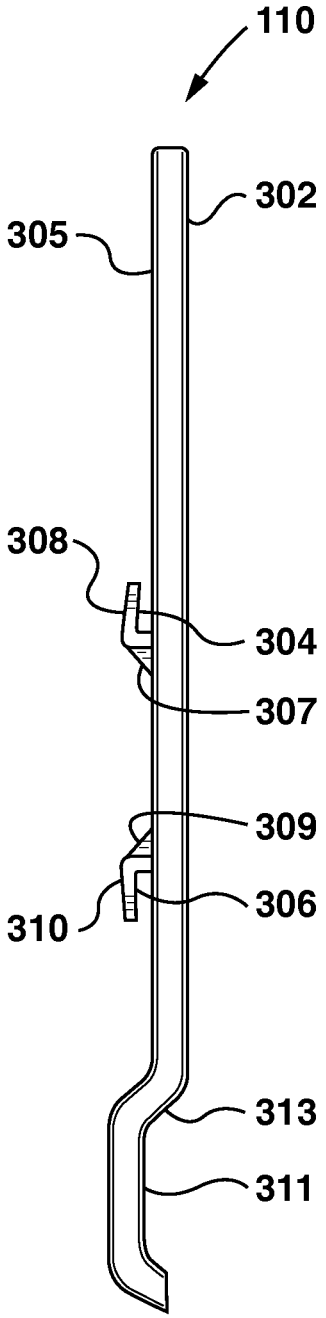
FIG. 3 shows a vertical cross-sectional view of an anchor of the wall cladding assembly of FIGS. 1A and 1B.
Figure 4:
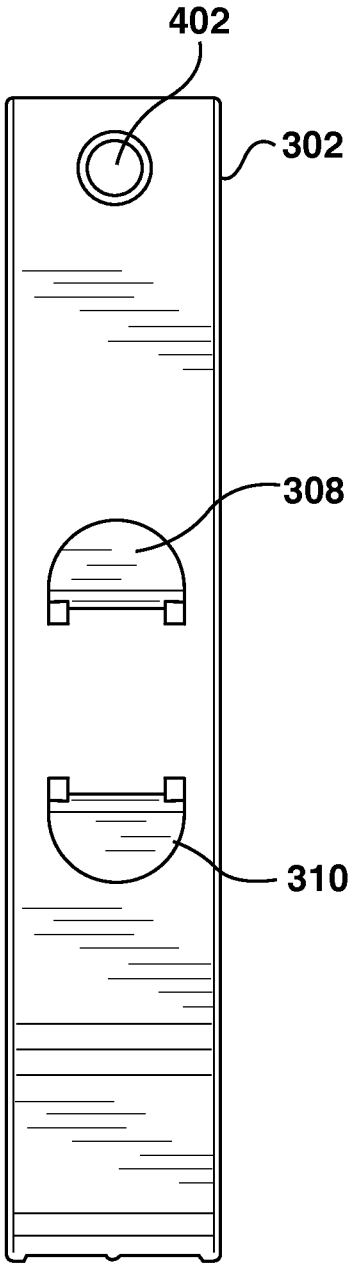
FIG. 4 shows a front view of the anchor of FIG. 3.

Reference is now made to FIGS. 3 and 4, which show a vertical cross-sectional view and a front view, respectively, of an anchor 110 of the wall cladding assembly 100 of FIGS. 1A and 1B. The anchors 110 may be used to attach the wall cladding tile 102 (shown in FIGS. 1A and 1B) to a substrate such as a wall or any façade surface. One or more anchors 110 can be fixedly secured to the mounting channel 108 of FIGS. 1A and 1B. Once the anchors 110 are secured to the mounting channel 108, the anchors 110 may be affixed to a substrate using various methods.

The anchor 110 includes an elongate anchor plate 302. In at least some embodiments, the anchor plate 302 may be a substantially planar sheet composed of a material such as plastic, steel or other synthetic material or a combination of such materials. For example, the anchor plate 302 may have a body that is a flat metal sheet having a thickness of less than 1 centimeter. The anchor plate 302 may have various shapes and sizes. As illustrated in FIG. 4, the anchor plate 302 may be rectangular and have two sets of parallel edges. In some embodiments, the length of the anchor plate 302 may be greater than 10 centimeters. In particular, in at least some embodiments, the length of the anchor plate 302 may be greater than the width, or the distance between the top edge and bottom edge, of the wall cladding tile 102. Other shapes and dimensions of the anchor plate 302 are also envisioned. It will be appreciated that the length of the anchor plate 302 may vary according to the dimensions of the corresponding wall cladding tile 102. For example, in some embodiments, the length of the anchor plate 302 may be at least 10 centimeters greater than the width of the wall cladding tile 102.

The anchor 110 also includes a pair of projections extending from the anchor plate 302. More specifically, the anchor 110 includes a first projection 304 and a second projection 306 which extend outwardly away from a first surface 305 of the anchor plate 302. The first projection 304 includes a first raised edge 307 extending from the first surface 305 and a first securing lip 308 extending along an outer end of the first raised edge 307. Similarly, the second projection 306 includes a second raised edge 309 extending from the first surface 305 and a second securing lip 310 extending along an outer end of the second raised edge 309. In at least some embodiments, the first projection 304 and the second projection 306 are integrally formed with the anchor plate 302.

The first raised edge 307 and the second raised edge 309 are generally perpendicular to a length of the anchor plate 302. The securing lips 308 and 310 are spaced apart from the first surface 305 and extend on a plane generally parallel to the anchor plate 302. As illustrated in FIG. 3, the first raised edge 307 defines a horizontal distance between the first securing lip 308 and the first surface 305 of the anchor plate 302. Similarly, the second raised edge 309 defines a horizontal distance between the second securing lip 310 and the first surface 305.

The first securing lip 308 and the second securing lip 310 can have various shapes. For example, in the embodiment of FIG. 4, the first securing lip 308 and the second securing lip 310 each extend from a raised edge to form a generally semi-circular shape in a plane parallel to the first surface 305 of the anchor plate 302. In some embodiments, the generally semi-circular first securing lip 308 and second securing lip 310 may each have a circular groove defined on its perimeter, as in FIG. 4.

The first securing lip 308 extends in a direction away from the second projection 306 and the second securing lip 310 extends in a direction away from the first projection 304. In other words, the first securing lip 308 and the second securing lip 310 extend in opposite directions along a plane parallel to the first surface 305 of the anchor plate 302.

In at least some embodiments, the body of the anchor plate 302 may include a flat portion and a raised portion 311. The anchor plate 302, having a substantially flat body, may be bent at a point 313 away from the plane defined by the flat portion of the anchor plate 302 towards the raised portion 311. In some embodiments, the raised portion 311 may be located near one end along the length of the anchor plate 302. For example, as shown in FIG. 3, the raised portion 311 may be near the bottom end of the anchor plate 302. In some embodiments, the raised portion 311 may be parallel to the plane defined by the flat portion of the anchor plate 302. The anchor plate 302 may be flexible at or around the raised portion 311. That is, in at least some embodiments, a portion of the anchor plate 302 near the raised portion 311 may be flexible, allowing slight movement of the raised portion 311 with respect to the flat portion of the anchor plate 302.

The mechanism for securing the anchor 110 to the mounting channel 108 of FIG. 1B involves engaging the securing lips 308 and 310 with the first recess 212 and second recess 214, respectively, defined by the mounting channel 108 of FIG. 2. In at least some embodiments, a first portion of the first securing lip 308 is sized to fit in the first recess 212 of FIG. 2 and a second portion of the second securing lip 310 is sized to fit in the second recess 214 of FIG. 2. For example, the first portion of the first securing lip 308 may have a thickness that is less than or equal to the depth of the first recess 212 and a length that is less than or equal to the height of the first recess 212. Similarly, the second portion of the second securing lip 310 may have a thickness that is less than or equal to the depth of the second recess 214 and a length that is less than or equal to the height of the second recess 214. In particular, the first recess 212 is sized to receive and fixedly retain the first portion of the first securing lip 308 and the second recess 214 is sized to receive and fixedly retain the second portion of the second securing lip 310.

In order to ensure that the anchor 110 is fastened to the mounting channel 108 such that its position is fixed relative to the mounting channel, the first projection 304 is spaced apart from the second projection 306 on the first surface 305 of the anchor plate 302 such that when the first portion of the first securing lip 308 engages and fits in the first recess 212, the second portion of the second securing lip 310 is adapted to engage and fit in the second recess 214. That is, the engagement between the first securing lip 308 and the first recess 212 and the engagement between the second securing lip 310 and the second recess 214 occurs simultaneously.

The fastening of the anchor 110 to the mounting channel 108 can be performed in numerous ways. For example, the anchor plate 302 can be manipulated such that the first securing lip 308 and the second securing lip 310 can slidably engage the first recess 212 and the second recess 214 of the mounting channel 108, respectively. The anchor plate 302 can first be positioned adjacent and parallel to the base plate 202 to align the first securing lip 308 and the second securing lip 310 with the first recess 212 and the second recess 214, and the securing lips can then be slid along the length of the recesses to a desired horizontal position on the mounting channel 108. Once in the desired horizontal position, the first portion of the first securing lip 308 and the second portion of the second securing lip 310 will simultaneously engage and be fit in the first and second recesses 212 and 214.

In a further example, the fastening mechanism may involve rotational movement of the anchor plate 302 with respect to the mounting channel 108. The anchor plate 302 can be positioned parallel to the base plate 202 and longitudinally aligned with the vertical space 215 defined by the first lip 208 and the second lip 210 of the mounting channel 108, such that the first surface 305 of the anchor plate 302 is faced towards the base plate 202. In other words, the anchor plate 308 may be positioned such that the width of the anchor plate 308 is aligned with the vertical space 215. The anchor plate 302 may be moved horizontally with respect to the mounting channel 108 such that the first projection 304 and the second projection 306 are at desired positions relative to the mounting channel 108. The anchor plate 302 can then be rotated clockwise or counter-clockwise by approximately 90 degrees, causing the first securing lip 308 and the second securing lip 310 to simultaneously engage the first recess 212 and the second recess 214, respectively.

When the first portion of the first lip 308 is fit in the first recess 212, the first portion frictionally engages at least one of the base plate 202, the first flange 204 and the first lip 208. Similarly, when the second portion of the second lip 310 is fit in the second recess 214, the second portion frictionally engages at least one of the base plate 202, the second flange 206 and the second lip 210. For example, the first portion of the first lip 308 may press against one or more of the inner surface of the first flange 204, the inner surface of the first lip 208 or the outer surface 205 of the base plate 202.

When the anchor 110 is secured to the mounting channel 108, the anchor 110 is positioned substantially orthogonal to the mounting channel 108, as illustrated in FIG. 1B. In this secured position, at least a first section of the anchor plate 302 extends above the top edge of the wall cladding tile 102. In at least some embodiments, the anchor plate 302 may have one or more holes 402 defined on the first section. The holes 402 may be configured to receive a plurality of screws, nails or other fasteners for attaching the anchor 110 to a substrate such as a wall or façade surface or a panel backing.

Figure 5B:
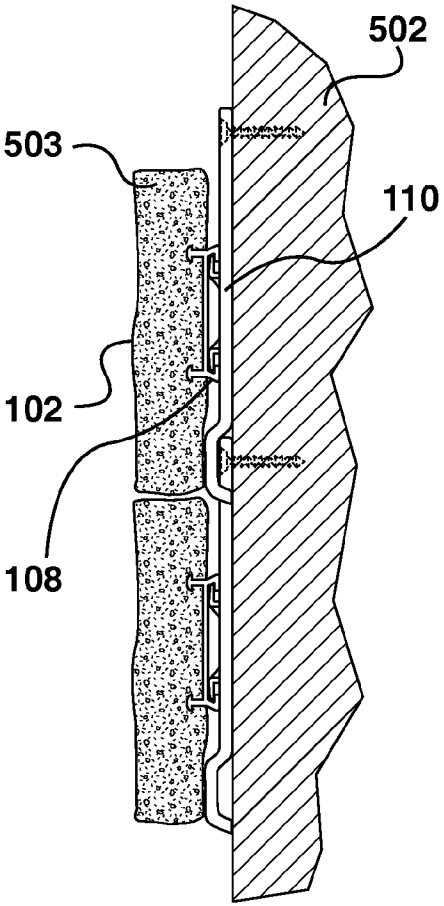
FIGS. 5A and 5B show a front view and a vertical cross-sectional view of a plurality of wall cladding assemblies installed on a substrate.
Figure 5A:
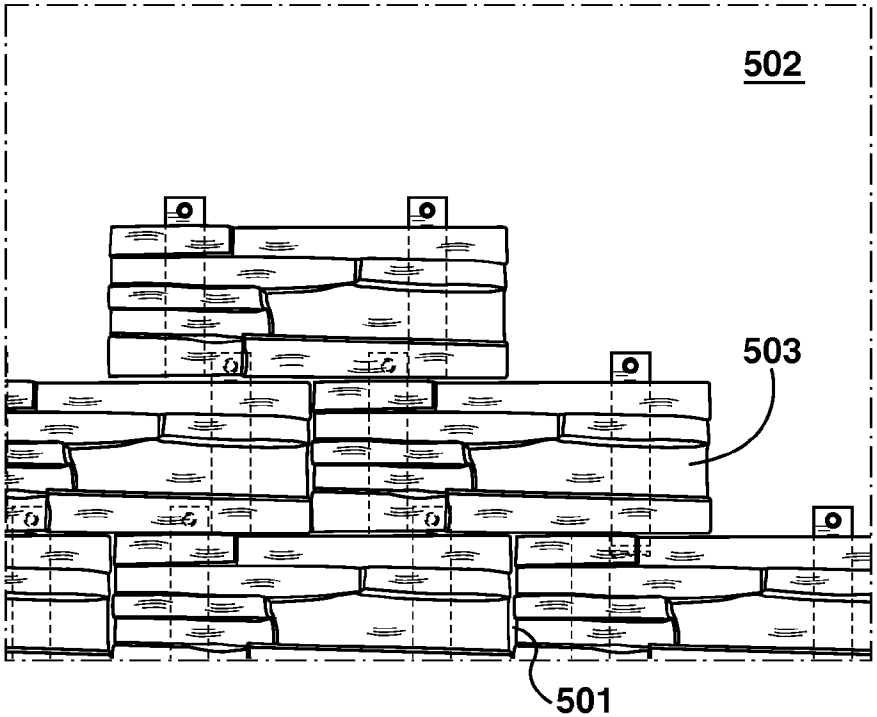

Reference is now made to FIG. 5A which shows an example arrangement of a plurality of wall cladding assemblies when installed on a vertical substrate 502. A first wall cladding assembly 501 is installed by placing it at a desired position along the substrate 502. In FIG. 5A, the first wall cladding assembly 501 is aligned to a bottom edge of the substrate 502. The first wall cladding assembly 501 is affixed to the substrate 502 by using a fastener, such as a screw, to secure the at least one anchor of the first wall cladding assembly 501 to the substrate 502. Once the first wall cladding assembly 501 is installed, one or more wall cladding assemblies can be installed adjacent to or above the first wall cladding assembly 501 on the substrate 502. For example, in FIG. 5A, a second wall cladding assembly 503 is arranged on the substrate 502 such that its bottom edge is aligned with the top edge of the first wall cladding assembly 501. In at least some embodiments, the second wall cladding assembly 503 can be installed by first sliding a protruding bottom portion of the anchor plate 505 affixed to the second wall cladding tile 506 behind the wall cladding tile 504 of the first wall cladding assembly 501 so as to align the bottom edge of the second wall cladding assembly 503 with the top edge of the first wall cladding assembly 501. That is, at least a portion of the anchor plate 505 affixed to the second wall cladding tile 506 may slide into and fit in a horizontal space between the wall cladding tile 504 of the first wall cladding assembly 501 and the substrate 502. A top portion of the anchor affixed to the second wall cladding assembly 503 may then be fastened to the substrate 502 using, for example, screws or adhesives.

FIG. 5B shows a vertical cross-sectional view of the arrangement of the first wall cladding assembly 501 and the second wall cladding assembly 503 on the vertical substrate 502. A protruding bottom portion of the anchor plate 505 secured to the second wall cladding tile 506 can be slid behind the wall cladding tile 504 of the first wall cladding assembly 501, as in the example of FIG. 5B. This protruding bottom portion of the anchor plate 505 may include a raised portion 507. In some embodiments, the raised portion of the anchor plate may rest against one or both of the wall cladding tile 506 of the second wall cladding assembly 503 and the wall cladding tile 504 of the first wall cladding assembly 501. The raised portion of the anchor plate 505 may serve to support and reinforce the wall cladding tile 504 of the first wall cladding assembly 501 while preserving a horizontal distance between the wall cladding tile 504 and the substrate 502. More generally, in at least some embodiments, an anchor plate corresponding to an upper wall cladding assembly may have a protruding bottom section that extends below the bottom edge of the corresponding wall cladding tile, the protruding bottom section having a raised portion for supporting a surface of the wall cladding tile of a lower wall cladding assembly positioned immediately below the upper wall cladding assembly. A contiguous arrangement of multiple such adjacent wall cladding assemblies and corresponding tile-supporting anchor plates can provide a sturdy and stable wall cladding surface.

As shown in FIG. 5B, the top portion of the anchor plate affixed to the first wall cladding assembly 501 is located behind the wall cladding tile 506 of the second wall cladding assembly 503 when the second wall cladding assembly 503 is in place. In the example of FIG. 5A, the bottom edge of the wall cladding tile 504 of the first wall cladding assembly 501 is aligned with the bottom edge of the substrate 502 and the first wall cladding assembly 501 forms part of a bottom row of wall cladding assemblies installed on the substrate 502. When installing the first wall cladding assembly 501, any portion of the anchor plate affixed to the first wall cladding assembly 501 that protrudes below the bottom edge of the wall cladding tile 504 can be cut off to ensure that the first wall cladding assembly 501 aligns with the bottom edge of the substrate 502. In general, an anchor plate corresponding to a wall cladding assembly along a bottom row on a substrate can be truncated to remove a protruding bottom section that extends past the bottom edge of the wall cladding tile of the wall cladding assembly. In this way, the bottom edge of an arrangement of wall cladding assemblies on a substrate can be rendered smooth and may accommodate flexible installation on a wall or façade surface.

The various example embodiments presented above are merely examples. Variations of the innovations described herein will be apparent to persons of ordinary skill in the art, such variations being within the intended scope of the present application. In particular, features from one or more of the above-described example embodiments may be selected to create alternative example embodiments including a sub-combination of features which may not be explicitly described above. In addition, features from one or more of the above-described example embodiments may be selected and combined to create alternative example embodiments including a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A wall cladding assembly, comprising:

a wall cladding tile having a first surface that is at least partially covered with cladding material and a second surface opposite to the first surface;

a mounting channel attached to the second surface, the mounting channel including:

a planar base plate disposed on the second surface;

a first flange and a second flange along two parallel edges of the base plate, the flanges extending outwardly away from the second surface;

a first lip along an outer edge of the first flange and a second lip along an outer edge of the second flange, the lips being spaced apart from and extending generally parallel to the base plate, wherein the first lip, the first flange and the base plate define a first recess and the second lip, the second flange and the base plate define a second recess; and at least one anchor to be secured to the mounting channel, the at least one anchor including:

an elongate anchor plate; and a first projection and a second projection extending outwardly from a first surface of the anchor plate, the first projection having a first securing lip and the second projection having a second securing lip, the securing lips being spaced apart from and extending generally parallel to the anchor plate, wherein a first portion of the first securing lip is sized to fit in the first recess and a second portion of the second securing lip is sized to fit in the second recess.

2. The wall cladding assembly of claim 1, wherein the first projection comprises a first raised edge and the second projection comprises a second raised edge, the raised edges being generally perpendicular to a length of the anchor plate and extending outwardly from the anchor plate, and wherein the first securing lip extends along an outer end of the first raised edge and the second securing lip extends along an outer end of the second raised edge.

3. The wall cladding assembly of claim 1, wherein the first lip extends in a direction from the first flange towards the second flange and the second lip extends in a direction from the second flange towards the first flange.

4. The wall cladding assembly of claim 3, wherein the first securing lip extends in a direction away from the second projection and the second securing lip extends in a direction away from the first projection.

5. The wall cladding assembly of claim 4, wherein the first projection is spaced apart from the second projection on the first surface of the anchor plate such that when the first portion of the first securing lip is fit in the first recess, the second portion of the second securing lip fits in the second recess.

6. The wall cladding assembly of claim 5, wherein the first portion of the first securing lip frictionally engages at least one of the base plate, the first flange and the first lip when the first portion is fit in the first recess and wherein the second portion of the second securing lip frictionally engages at least one of the base plate, the second flange and the second lip when the second portion is fit in the second recess.

7. The wall cladding assembly of claim 1, wherein the first recess is sized to receive and fixedly retain the first portion of the first securing lip and the second recess is sized to receive and fixedly retain the second portion of the second securing lip.

8. The wall cladding assembly of claim 1, wherein the wall cladding tile has a rectangular, trapezoidal or rounded shape.

9. The wall cladding assembly of claim 1, wherein the base plate of the mounting channel extends lengthwise along a length of the wall cladding tile.

10. The wall cladding assembly of claim 1, wherein the anchor plate of the at least one anchor comprises a substantially planar sheet composed of one or more synthetic materials.

11. The wall cladding assembly of claim 1, wherein a length of the anchor plate is greater than a width of the second surface.

12. The wall cladding assembly of claim 11, wherein the anchor plate has one or more holes defined thereon near at least one of its longitudinal ends.

13. The wall cladding assembly of claim 1, wherein the first projection and the second projection are integrally formed with the anchor plate.

14. The wall cladding assembly of claim 1, wherein the base plate of the mounting channel has a smaller surface area than the second surface.

15. The wall cladding assembly of claim 1, wherein when the at least one anchor is secured to the mounting channel, the at least one anchor is oriented substantially perpendicular to the mounting channel.

16. The wall cladding assembly of claim 15, wherein the at least one anchor has a protruding bottom section that extends below a bottom edge of the wall cladding tile when the at least one anchor is secured to the mounting channel.

17. The wall cladding assembly of claim 16, wherein a bottom edge of the wall cladding tile may be shaped to align with a top edge of a second wall cladding tile of a second wall cladding assembly, the second wall cladding assembly being configured to be installed at a position immediately below the wall cladding assembly on a substrate, and wherein the protruding bottom section of the at least one anchor has a raised portion for supporting a surface of the second wall cladding tile.

18. The wall cladding assembly of claim 17, wherein the raised portion is distanced from and generally parallel to a plane defined by a flat portion of the anchor plate.

19. The wall cladding assembly of claim 1, wherein the anchor plate is made of plastic or steel.

* * * * *